US012692689B2

(12) United States Patent
Bohms et al.

(10) Patent No.: US 12,692,689 B2
(45) Date of Patent: Jul. 28, 2026

(54) DRAINAGE CHANNEL AND USE OF A DRAINAGE CHANNEL IN A SANITARY FACILITY, IN PARTICULAR A SHOWER FACILITY

(71) Applicant: ACO AHLMANN SE & CO. KG, Budelsdorf (DE)

(72) Inventors: Michael Bohms, Bad Salzungen (DE); Katrin Kropp, Bad Salzungen (DE); Christin Schlotzhauer, Gehaus (DE); Alexander Tittmar, Dorndorf (DE)

(73) Assignee: ACO AHLMANN SE & CO. KG, Budelsdorf (DE)

( * ) Notice: Subject to any disclaimer, the term of this patent is extended or adjusted under 35 U.S.C. 154(b) by 220 days.

(21) Appl. No.: 18/591,476

(22) Filed: Feb. 29, 2024

(65) Prior Publication Data

US 2024/0295104 A1 Sep. 5, 2024

(30) Foreign Application Priority Data

Mar. 2, 2023 (DE) ..... 10 2023 105 166.0

(51) Int. Cl.
*E03C 1/23* (2006.01)
*E03C 1/00* (2006.01)

(52) U.S. Cl.
CPC ..... *E03C 1/23* (2013.01); *E03C 2001/005* (2013.01)

(58) Field of Classification Search
CPC ..... E03C 1/23; E03C 1/22; E03C 2001/005; E03F 5/0408
See application file for complete search history.

(56) References Cited

U.S. PATENT DOCUMENTS 4,815,888 A 3/1989 Stegmeier
5,489,163 A * 2/1996 Thomann ..... E03F 5/0408 405/126

(Continued)

FOREIGN PATENT DOCUMENTS

CN 106759814 B 10/2022
DE 9421617 U1 3/1996

(Continued)

OTHER PUBLICATIONS

The Extended European Search Report issued in corresponding European Patent Application No. 241660566.6; Mailing Date: Jul. 29, 2024.

(Continued)

*Primary Examiner* — Janie M Loeppke
(74) *Attorney, Agent, or Firm* — Chrisman Gallo Tochtrop LLC

(57) ABSTRACT

The invention relates to a drainage channel for sanitary facilities, in particular shower facilities, with a channel body extending in a longitudinal direction, comprising:

at least one first channel section having a bottom and at least two side walls arranged opposite one another at the bottom, wherein the first channel section is adapted to accommodate at least one heat exchanger unit for heat recovery; and at least one second channel section with a receiving area for receiving a channel cover element, which adjoins the first channel section above, wherein the channel body has at least one undercut through which the receiving area of the second channel section is arranged transversely to the longitudinal direction within at least one of the side walls, in particular both side walls, of the first channel section.

21 Claims, 4 Drawing Sheets

(56) References Cited

U.S. PATENT DOCUMENTS

| | | | | |
|---|---|---|---|---|
| 6,000,881 | A | 12/1999 | Becker | |
| 8,347,424 | B2 * | 1/2013 | Wroblewski | E04G 23/02 52/302.1 |
| 2016/0341490 | A1 | 11/2016 | Schmid | |
| 2021/0040721 | A1 * | 2/2021 | Larson | E03F 5/0408 |

FOREIGN PATENT DOCUMENTS

| | | | | |
|---|---|---|---|---|
| DE | 20 2015 008 66 | U1 | 4/2017 | |
| EP | 2273223 | A1 * | 1/2011 | F24D 17/0005 |

OTHER PUBLICATIONS

The Examination Report issued in corresponding Germany Patent Application No. 10 2023 105 166.0; Dated: Dec. 8, 2023.

* cited by examiner

DRAINAGE CHANNEL AND USE OF A DRAINAGE CHANNEL IN A SANITARY FACILITY, IN PARTICULAR A SHOWER FACILITY

The invention relates to a drainage channel and the use of a sanitary facility, in particular a shower facility, with such a drainage channel. A drainage channel according to the preamble of claim 1 is known, for example, from DE 20 2015 008 662 U1.

It is well known that channel systems are used in sanitary facilities to drain water. Such channel systems are used to drain bottom surfaces and are installed recessed into the bottom in such a way that water to be drained away is absorbed and drained away from the bottom surface. In particular when using drainage channels in showers, for example private showers and collective showers, it is conventional to install the drainage channels substantially flush with the bottom surface. The part of the drainage channels that is visible from the outside should be visually appealing to the user.

Furthermore, drainage channels for shower facilities are often required to recover the heat lost through the water to be drained away. For example, a shower channel is known from the aforementioned DE 20 2015 008 662 U1 which has a heat exchanger in a double jacket around the channel body. The heat exchanger has a plurality of tubes for a heat transfer medium, which tubes rest on at least one wall of the channel body. When installed, the shower channel comprises an area that is visible from the outside, in which a cover element that is very large or wide can be arranged. This is due to the large width of the channel body with the double jacket to accommodate the heat exchanger. The shower channel does not have an aesthetic appearance, but appears rather clumsy. It is therefore an underlying object of the invention to specify a drainage channel which, on the one hand, enables the inclusion of a functional unit for heat recovery and, on the other hand, has a visually appealing design when installed. Furthermore, it is an underlying object to specify the use of such a drainage channel in a sanitary facility.

According to the invention, this object is achieved with respect to the drainage channel by the subject matter of claim 1. With respect to the use of a sanitary facility with such a drainage channel, the above-mentioned object is achieved by the subject matter of claim 21.

Specifically, the object is achieved by a drainage channel for sanitary facilities, in particular shower facilities, wherein the drainage channel has a channel body extending in a longitudinal direction and comprising the following:

- at least one first channel section having a bottom and at least two side walls arranged opposite one another on the bottom, wherein the first channel section is adapted to accommodate at least one heat exchanger unit for heat recovery; and
- at least one second channel section with a receiving area for receiving a channel cover element, which adjoins the first channel section above.

According to the invention, the channel body has at least one undercut through which the receiving area of the second channel section is arranged transversely to the longitudinal direction within at least one of the side walls, in particular both side walls, of the first channel section.

The invention has the essential advantage that the channel body has two channel sections of different widths. Due to the undercut of the channel body, the receiving area of the second channel section is positioned transversely to the longitudinal direction of the channel body within one of the two side walls of the first channel section. The undercut of the channel body therefore enables the receiving area of the second channel section to be offset towards the center of the channel. In other words, the channel body comprises at least one projection through the undercut, through which the receiving area for the channel cover element is positioned transversely to the longitudinal direction within one of the two side walls. Or, to put it another way, the channel section comprises a cross-sectional constriction due to the undercut. As a result, the width of the receiving area of the second upper channel section is reduced in the longitudinal direction of the channel body in relation to the width of the first lower channel section.

Preferably, the channel body has at least one undercut on the side of both side walls, such that the receiving area of the second channel section is arranged transversely to the longitudinal direction within the two side walls of the first channel section. In other words, the receiving area is preferably offset on both sides transversely to the longitudinal direction towards the center of the channel in such a way that the receiving area for the channel cover element is arranged completely within the side walls of the first channel section.

When the drainage channel is installed, the receiving area of the second channel section is visible from the outside. It can be flush with a bottom surface, for example, of a sanitary facility, in particular a shower facility. The reduced width compared to the first channel section allows a narrow and simple design of the receiving area of the second channel section and thus of a channel cover element accommodated therein. It is particularly visually appealing if the receiving area or the channel cover element accommodated therein have a narrow, elongated appearance. The drainage channel according to the invention allows such an appearance.

The second channel section is arranged on the first channel section. In other words, the two channel sections are arranged one above the other. The second channel section connects to the first channel section at the top. Or, to put it another way, the first channel section adjoins the second channel section below. The directions "above", "below", "on top", and "underneath" refer to the installation position of the drainage channel, in particular the channel body.

The first channel section, which, for example, accommodates at least one heat exchanger unit for heat recovery, is arranged below the bottom surface when the drainage channel is installed. The first channel section is covered by the floor surface and is therefore not visible from the outside. The first channel section is therefore irrelevant to the external appearance of the drainage channel because it is positioned below the bottom surface.

The invention has the further advantage that, due to the undercut of the channel body, the first channel section has a greater width than the receiving area of the second channel section above it. The first channel section thus provides a sufficiently wide interior space in which, for example, at least one heat exchanger unit and/or a siphon unit can be accommodated.

For the purposes of this application, the widths of the channel sections correspond to their cross-sectional widths. In other words, the widths of the channel sections correspond to their widths transverse to the longitudinal direction of the channel body.

The first channel section and/or the second channel section is/are preferably designed to run longitudinally along the channel body. It is preferred that the two opposite side walls and the bottom of the first channel section run in the longitudinal direction of the channel body, in particular parallel. Furthermore, it is preferred that the receiving area of the second channel section runs in the longitudinal direction of the channel body.

The drainage channel according to the invention is preferably used in a sanitary facility. The drainage channel is particularly preferably used as a shower channel in a shower device. In particular, the drainage channel can be used as a private shower channel or a collective shower channel. Other areas of application are possible.

Preferred embodiments of the invention are specified in the dependent claims.

In a preferred embodiment, the receiving area of the second channel section has an outer width transversely to the longitudinal direction which is smaller than a width, in particular inner and/or outer width, of the first channel section. The outer width of the receiving area of the second channel section corresponds to the maximum width of the receiving area transversely to the longitudinal direction. It is visually appealing if the receiving area has a constant outer width along its longitudinal extent. Particularly preferably, the outer width of the receiving area is smaller than an inner width of the first channel section. The inner width of the first channel section corresponds to the width of the interior space, which is delimited transversely to the longitudinal direction by the two side walls. The outer width of the receiving area of the second channel section is preferably smaller than the clear width of the first channel section, in particular the interior of the first channel section. The receiving area for the channel cover element is therefore narrow and therefore has an aesthetic design.

In another preferred embodiment, the undercut is an indentation running towards the center of the channel and formed between the first and second channel sections. In this embodiment, the side walls of the first channel section merge into the second channel section above, in particular continuously. The indentation is preferably formed on one of the two side walls of the first channel section. If the undercut is formed on both sides of the channel body, both side walls of the first channel section have such an indentation. Due to the arrangement of the undercut between the first and second channel sections, the channel body preferably has a bottle-shaped, in particular bottleneck-shaped, cross section. The indentation has the advantage that it can be produced quickly and easily using appropriate tools. The indentation is preferably formed by reshaping one of the side walls, in particular both side walls.

The receiving area of the second channel section preferably comprises at least one shoulder extending towards the center of the channel for supporting the channel cover element, which is formed by the undercut. The receiving area preferably has a shoulder on the side of one of the side walls of the first channel section. In other words, the receiving area has two shoulders that are opposite each other with respect to the center of the channel. The shoulder has the advantage that the channel cover element can be easily inserted into the receiving area. The shoulder represents a downward limit for the channel cover element. The shoulder preferably limits an insertion depth of the channel cover element. The shoulder is preferably designed to hold the channel cover element in a form-fitting and/or friction-locking manner.

The shoulder preferably has at least one support surface which is oriented obliquely towards the center of the channel. When installed, the channel cover element preferably rests on the support surface. The support surface allows the channel cover element to abut directly. Additionally or alternatively, the channel cover element can abut the support surface indirectly. In addition to the mere support and holding function, the support surface can also take on a sealing function. In other words, the support surface can also serve as a sealing surface.

In a preferred embodiment, the channel body has at least one third channel section which adjoins the second channel section, wherein the second channel section is arranged between the first and third channel sections. The third channel section offers the advantage that the drainage channel can be installed deeper into a floor area. The third channel section preferably serves as a raising element to increase the channel height. In other words, the third channel section is preferably arranged on the second channel section. Preferably, the third channel section forms at least one inlet, in particular with a gradient for the liquid to be drained, which inlet extends in the longitudinal direction at least beyond the first and/or second channel section. This is particularly advantageous for the use of the drainage channel as a collecting shower channel, since such an extended channel length promotes the efficient removal of liquids, in particular (shower) water.

The third channel section comprises at least one other receiving area for at least one other channel cover element, in particular a grate. To cover and so that the third channel section can be comfortably walked on, the further receiving area is provided, which is designed to accommodate at least one, but preferably several, channel cover elements.

The drainage channel preferably comprises at least one channel flange, in particular a connecting collar, which is arranged along the outer circumference to connect a surface to be drained, in particular bottom surface, to the receiving area of the second channel section and/or to the other receiving area of the third channel section. The channel flange can be designed to be completely or partially circumferential, in particular in sections. The undercut, in particular the shoulder, of the channel body is preferably formed at least in sections between the channel flange and the first channel section. The channel flange allows a tight connection of a bottom surface, for example a shower bottom, at least above the first channel section.

In a preferred embodiment, the drainage channel has at least one channel cover element which is accommodated in the receiving area of the second channel section and comprises a channel which is fluidically connected to the first channel section. Liquid to be drained during operation flows through the channel into the first channel section. The channel preferably forms at least one extension with at least one passage which projects into the first channel section. The channel cover element is preferably part of a siphon unit for odor-proof sealing of the first channel section against the second channel section. The advantage here is that the channel cover element, on the one hand, covers the first channel section and, on the other hand, allows the formation of a siphon through the channel.

The passage of the channel can be slot-shaped. The passage can extend longitudinally. The passage can extend over the entire length, in particular in the longitudinal direction, of the channel cover element. The channel cover element is preferably accommodated substantially flush at the top in the second channel section.

The channel cover element preferably comprises at least one edge which runs obliquely towards the center of the channel and which abuts the shoulder, in particular the support surface, in the receiving area of the second channel section. The edge is preferably designed as at least one bending tab. The edge is preferably designed to run around the outside of the channel cover element. The edge is intended to rest on the support surface of the shoulder of the receiving area of the second channel section. The channel cover element rests on the shoulder of the receiving area of the second channel section, covering the edge. In other words, the channel cover element is hung into the receiving area by means of the edge. Furthermore, the edge allows the arrangement of a sealing element.

The oblique edge can be designed to complement the shoulder of the second channel section. In other words, the edge can extend parallel to the shoulder. This improves the positioning of the channel cover element in the second channel section. Particularly advantageously, the complementary design of the shoulder and edge means that the channel cover element self-centers when inserted, in particular when hung in. Sections of the edge and/or the shoulder can be designed to be complementary. For example, the edge and/or the shoulder can include at least one elevation for abutment.

Particularly preferably, the channel cover element has at least one recess above the channel, in which at least one sieve element, in particular a hair sieve, is inserted. In other words, the channel cover element comprises at least one offset area in which at least one sieve element is arranged in a recessed manner. The sieve element advantageously retains any kind of contamination, which, for example, protects a heat exchanger unit arranged in the first channel section from contamination. If the drainage channels are used as a shower channel, the sieve element is primarily used to retain hair.

Preferably, the top of the sieve element is arranged flush, in particular flush-mounted, with a surface of the channel cover element. The channel cover element particularly preferably has rounded edges in the transition area between the surface and the recess. This provides a particularly gentle feeling when stepping on the channel cover element. The sieve element and/or the channel cover element are preferably designed in such a way that the sieve element can be removed in the inserted state by pressing it down and tilting it up ("tip and flip").

In another preferred embodiment, the drainage channel has at least one sealing element which is arranged between the edge of the second channel section and the shoulder of the second channel section. The sealing element can be at least a plug-in seal that is attached to the edge. The sealing element can encompass a free end of the edge in such a way that it is nevertheless arranged at least in sections between the edge and the shoulder. The sealing element preferably abuts the support surface of the shoulder and the edge. The sealing element closes the first channel section against the cover element in an odor-proof manner.

The channel cover element can be braced by at least one locking device against the shoulder of the second channel section for compressing the/a sealing element. The locking device can comprise at least one screw, a twist lock, or the like. This means that the sealing element can be squeezed between the channel cover element and the shoulder of the second channel section for improved sealing.

The drainage channel preferably has at least one siphon unit with a siphon pot, wherein the channel cover element protrudes into the siphon pot to form a siphon. Preferably, the channel of the channel cover element projects into the siphon pot in such a way that a lower edge of the channel projects underneath an overflow edge of the siphon pot. As a result, a constantly standing liquid level, in particular water level, is formed or can be formed in the siphon pot during operation and, after initial operation, even when the drainage channel is not in use. In this embodiment, the channel cover element is partially associated with the siphon unit. This embodiment has the advantage that no separate immersion element has to be provided to form the siphon. The multifunctional channel cover element thus contributes to the compactness and simplicity of the drainage channel.

In a preferred embodiment, the drainage channel comprises at least one heat exchanger unit, which is arranged in the channel body, in particular in the/an interior space of the first channel section, such that during operation a liquid to be drained flows at least around sections of the heat exchanger, in particular directly. In this embodiment, the drainage channel meets the requirement of recovering the heat from the liquid to be drained by heat transfer. This is particularly advantageous when using the drainage channel as a shower channel, since the users of a shower device predominantly prefer water with a pleasant temperature and the heat from the shower water can therefore be used accordingly.

During operation, the heat exchanger unit is preferably in direct contact with the liquid to be drained. The heat exchanger unit is preferably connected in the flow direction downstream of the siphon unit. This means that only cleaned liquid comes into contact with the heat exchanger unit. This increases the service life and the efficiency of heat transfer.

The heat exchanger unit preferably has at least one heat transfer section, in particular at least one channel element for a heat transfer medium. The heat transfer section may comprise a plurality of tubes which are connected to one another, wherein the heat transfer medium is able to flow in the tubes. Alternatively or additionally, profile pipes, ducts, or the like are also conceivable. Such a heat exchanger unit provides sufficiently large heat transfer surfaces for efficient heat transfer.

The heat transfer section preferably runs in the longitudinal direction along at least one of the side walls of the channel body, at least in sections. It is advantageous if the heat transfer section runs over the entire length of the side wall. It is particularly advantageous if at least two of the heat exchanger units are provided, wherein one of the heat exchanger units runs over the entire length on one of the side walls. This increases the heat recovery performance of the drainage channel.

The heat exchanger unit preferably comprises at least one feed connection and at least one return connection, wherein the feed connection and/or the return connection is/are arranged on an end wall of the channel body or on one of the side walls of the channel body. The channel body has at least one outlet nozzle for the liquid to be drained, which outlet nozzle is arranged on an end wall of the channel body or on one of the side walls of the channel body or on the bottom of the channel body. The drainage channel allows for a variety of connection options, so that the channel can be configured to meet specific requirements.

When using the drainage channel according to the invention in a sanitary facility, in particular a shower facility, the drainage channel is inserted into a bottom in such a way that liquids to be drained away during use of the sanitary facility drain through the drainage channel, wherein heat is recovered by at least one heat exchanger unit. Regarding the advantages of using a drainage channel according to the invention, reference is made to the advantages explained in connection with the drainage channel.

The invention is explained in more detail below with reference to the accompanying drawings. The embodiments shown represent examples of how the drainage channel according to the invention can be designed.

Wherein.

In the following description, the same reference numerals are used for identical and identically acting parts.

Figure 1:
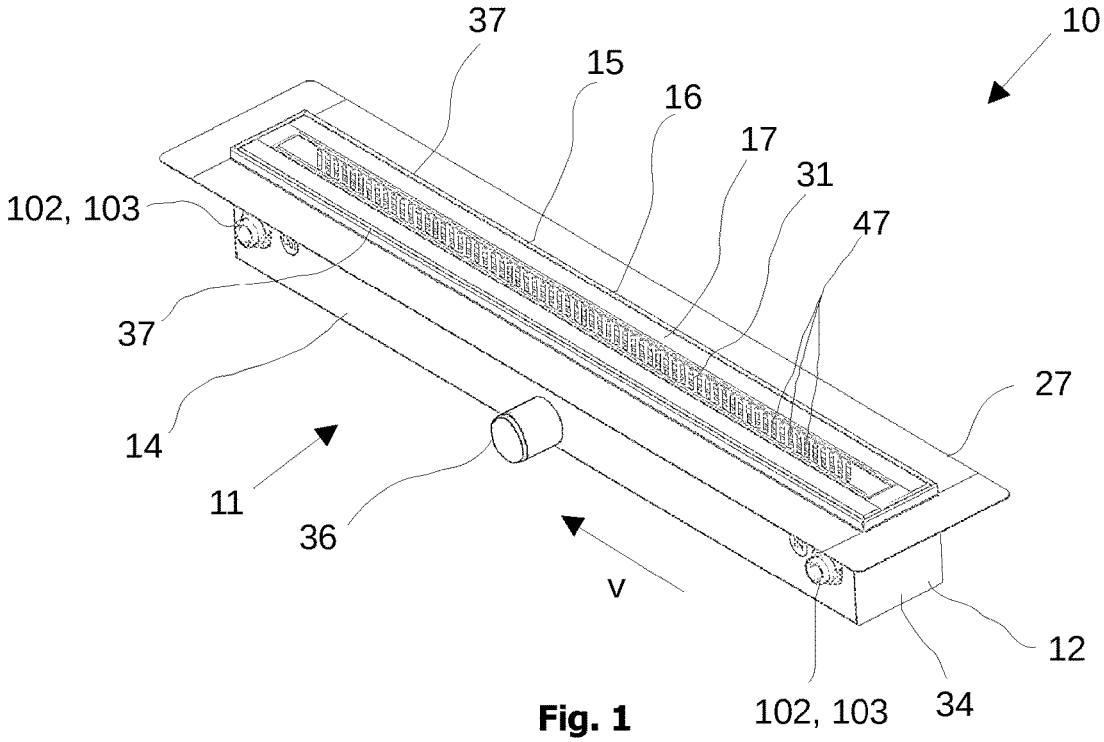
FIG. 1 shows a perspective view of a drainage channel according to a preferred embodiment of the invention.
Figure 5:
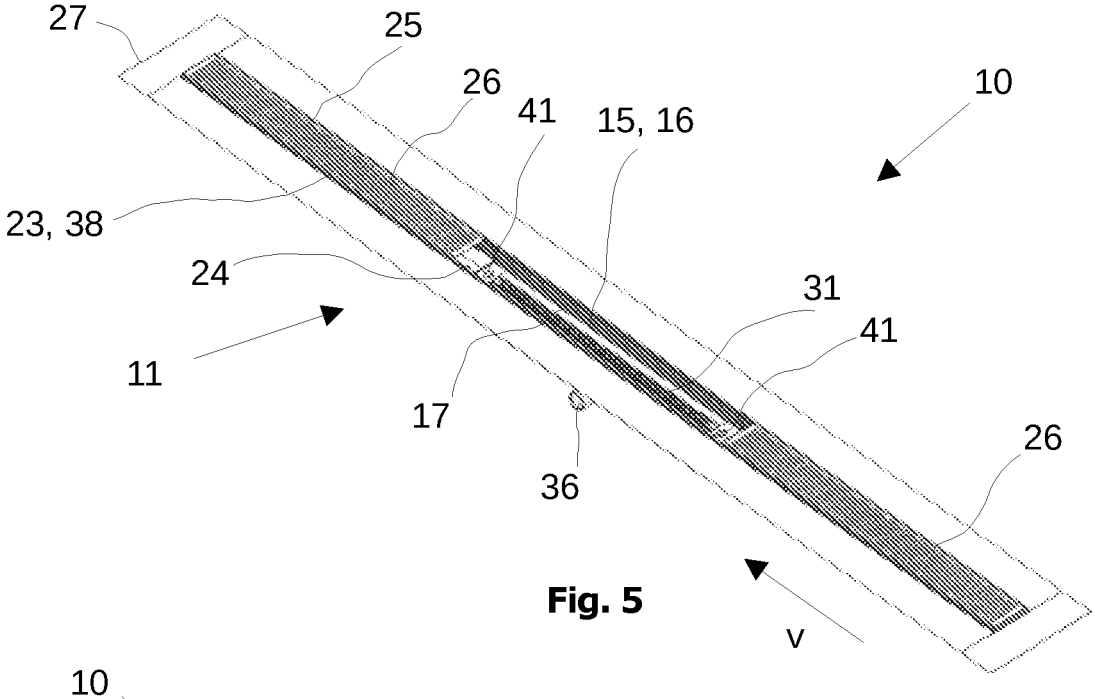
FIG. 5 shows a perspective view of a drainage channel according to another preferred embodiment of the invention.

FIG. 1 shows a drainage channel 10 according to an embodiment of the invention, which is preferably used as a shower channel in shower facilities. Below, the drainage channel 10 is generally referred to as a shower channel 10. Specifically, a shower channel 10 for a private shower is shown in FIG. 1. FIG. 5, on the other hand, shows a shower channel 10 for a collective shower, in which several shower places are provided next to one another. The difference between the two shower channels 10 will be discussed later.

The shower channel 10 according to FIG. 1 comprises a channel body 11 extending in a longitudinal direction v with a first channel section 12 and a second channel section 15 positioned above it. In general, the channel body 11 has a longitudinal axis as the channel center, and the longitudinal direction v of the channel body 11 runs parallel thereto. The first channel section 11 has a bottom 13 and two side walls 14 running in the longitudinal direction v, which are arranged opposite one another on the bottom 13.

Furthermore, the first channel section 12 has two end walls 34, which are arranged opposite one another on one broad side of the bottom 13. The broad sides of the bottom 13 run transversely to the longitudinal direction v of the channel body 11. The two side walls 14 are arranged on the long sides of the bottom 13. The two side walls 14 run parallel. As can be seen, for example, in FIG. 2, the side walls 14 are arranged vertically, particularly in the installed position. It is possible that the side walls 14 can alternatively be angled.

The two side walls 14, the two end walls 34, and the bottom 13 delimit an interior space 35 of the first channel section 12. In the first channel section 12, specifically in its interior space 35, two heat exchanger units 100 for heat recovery and a siphon unit 200 for odor sealing are arranged, which will be discussed later.

Figure 2:
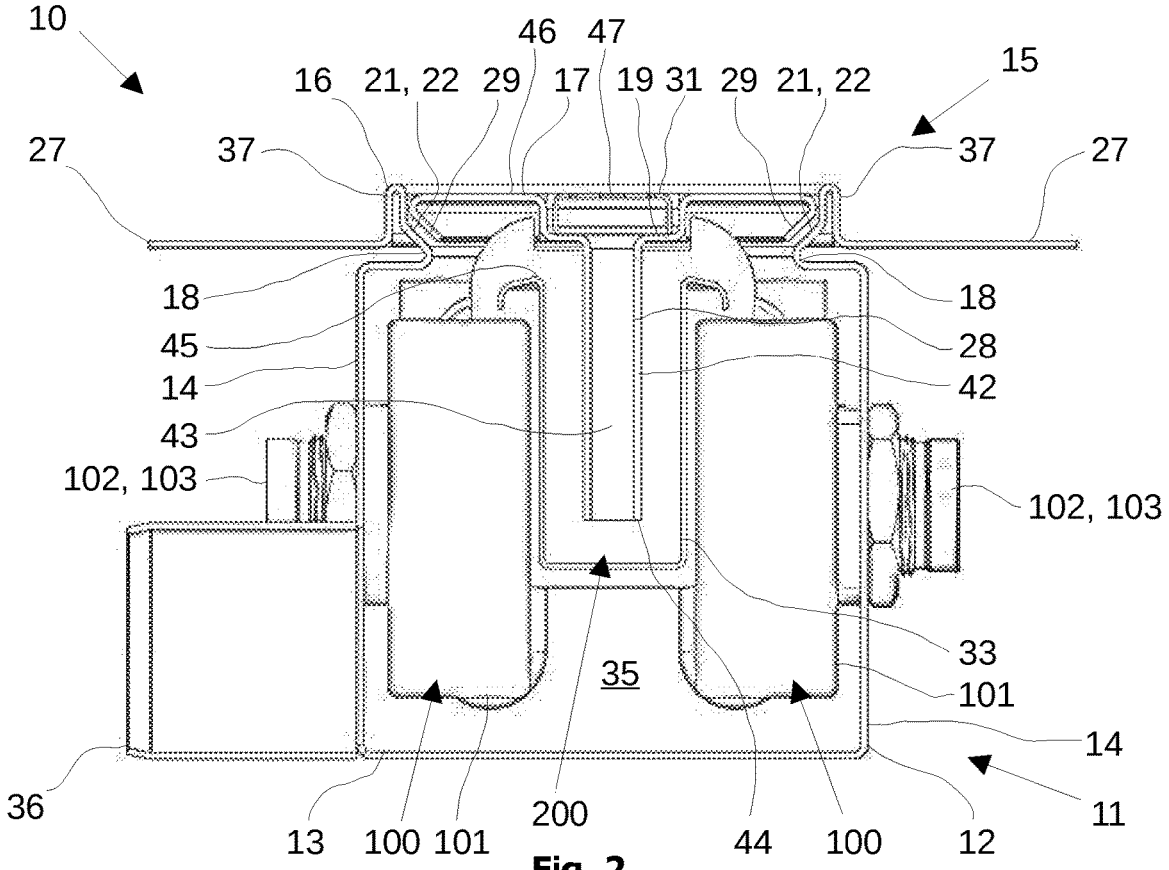
FIG. 2 shows a cross section of the drainage channel according to FIG. 1 in the area of the outlet nozzle.

The channel body 11 further comprises an outlet nozzle 36 through which liquid to be drained, in particular shower water, can be discharged. Hereafter the liquid is generally referred to as shower water. As can be seen in FIGS. 1 and 2, the outlet nozzle 36 is arranged on the outside of one of the two side walls 14. The outlet nozzle 36 is provided projecting from the side wall 14 of the first channel section 12, in particular laterally. Alternatively, the outlet nozzle 36 can be arranged to project laterally on one of the end walls 34 or can be arranged on the bottom 13 and oriented downwards.

The outlet nozzle 36 is fluidically connected to the interior space 35 of the first channel section 12. Specifically, the outlet nozzle 36 is arranged on the side wall 14 without any dead space. This means that when the shower water is drained through the outlet nozzle 36, no water residue caused by the outlet nozzle 36 remains in the interior space 35 of the first channel section 12.

The second channel section 15 adjoins the first channel section 12 at the top. The second channel section 15 has a receiving area 16 for receiving a channel cover element 17. The receiving area 16 is part of the second channel section 15 and is therefore also above the first channel section 12. FIG. 2 shows that the side walls 14 of the first channel section 12 merge continuously into side walls 37 of the second channel section 15. The side walls 14, 37 of the two channel sections 12, 15 are formed in one piece. The side walls 37 delimit the receiving area 16 for the channel cover element 17 laterally, in particular along the longitudinal direction v of the channel body 11. The side walls 37 can thus be viewed as part of the receiving area 16.

The channel body 11 also has a channel flange 27, which forms a collar surrounding the side walls 34 and end faces of the receiving area 16. The collar protrudes laterally from the side walls 34 and the end faces and thus allows the attachment of a bottom surface, for example a shower bottom.

Figure 4:
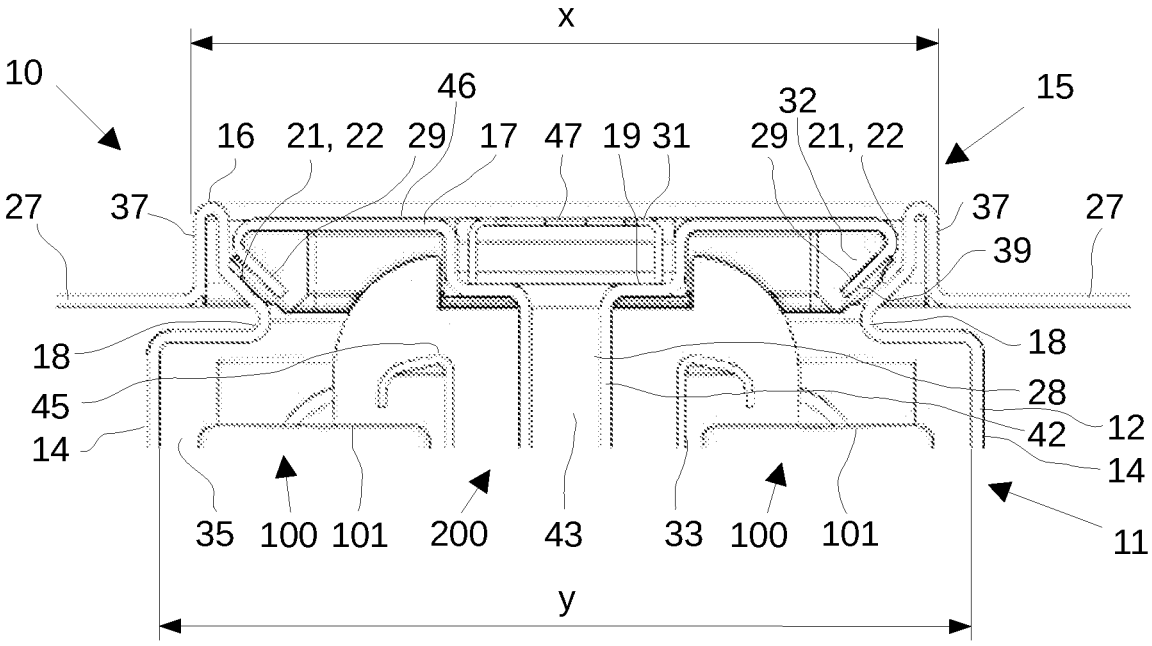
FIG. 4 shows a cross section of the drainage channel according to FIG. 1 including the sealing element shown in FIG. 3.

As can be seen in FIGS. 2 and 4, the receiving area 16 of the second channel section 15 has an outer width x transverse to the longitudinal direction v, which outer width is smaller than an inner width y of the first channel section 12. The outer width x of the receiving area 16 is the distance between the two outer sides of the side walls 37 of the receiving area 16. The inner width y of the first channel section 12 is the distance between the two inner sides of the side walls 14 of the first channel section 12. In other words, the inner width y of the first channel section 12 corresponds to the clear width of the interior space 35 of the first channel section 12.

The cross section of the channel body 11 is therefore bottle-shaped, in particular bottleneck-shaped. FIGS. 2 and 4 show that the channel body 11 comprises two undercuts 18 running in the longitudinal direction v, which results in the width ratio described above between the receiving area 16 and the first channel section 12. One undercut 18, respectively, is formed on the side of one of the side walls 14 of the first channel section 12 running in the longitudinal direction v. The undercuts 18 are indentations of the channel body 11 that run toward the center of the channel and are formed vertically between the first and second channel sections 12, 15. Specifically, the respective indentation is formed in a transition between the side walls 14 of the first channel section 12 and the side wall 37 of the second channel section 15.

The undercuts 18 are designed such that the receiving area 16 of the second channel section 15 is arranged transversely to the longitudinal direction v within the two side walls 14 of the first channel section 12. Specifically, the undercuts 18 are designed such that the two side walls 37 of the second channel section 15, in particular of the receiving area 16, are positioned transversely to the longitudinal direction v within the two side walls 14 of the first channel section 12. The undercuts 18 are partially located between the first channel section 12 and the channel flange 27, in particular the collar.

It is also evident from FIGS. 2 and 4 that the receiving area 16 of the second channel section 15 comprises two shoulders 21 extending towards the center of the channel for supporting the channel cover element 17, which shoulders are formed by the undercuts 18. Specifically, the shoulders 21 form the upper sections of the undercuts 18. The shoulders 21 each have a support surface 22 which is designed to slope towards the center of the channel.

According to FIGS. 1, 2, and 4, the shower channel 10 comprises a channel cover element 17 which is arranged in the receiving area 16 of the second channel section 15. The channel cover element 17 has on its long sides an edge 29 that runs obliquely towards the center of the channel. The channel cover element 17 rests across the edge 29 on the shoulders 21 of the receiving area 16 of the second channel section 15. The edge 29 is formed along the circumference of the channel cover element 17. The edge 29 and the shoulders 21 are designed to be complementary. The edge 29 runs parallel to the support surfaces 22 of the shoulders 21.

A sealing element 32 is arranged on the edge 29 of the channel cover element 17. In the present case, the sealing element 32 is attached to a free end of the edge 29. This can clearly be seen in FIG. 4. The sealing element 32 is designed to be elastically compressible. The sealing element 32 can be made of rubber or the like, for example. The sealing element 32 has a lip 39 which is arranged between the edge 29 of the channel cover element 17 and the support surface 22 of the shoulders 21 of the receiving area 16.

Figure 3:
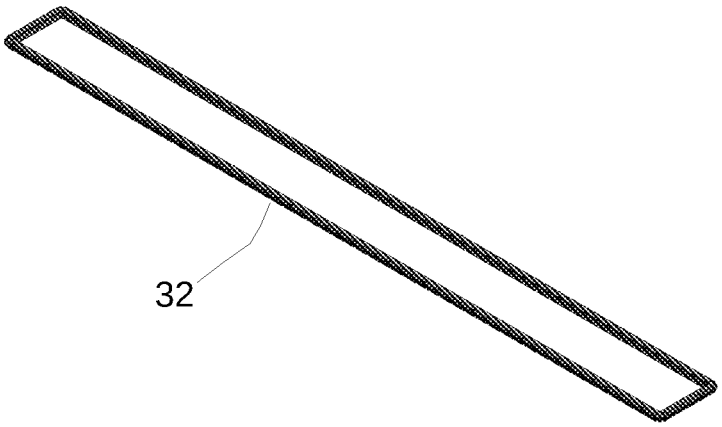
FIG. 3 shows a perspective view of a sealing element of the drainage channel according to FIG. 1.

FIG. 3 shows the sealing element 32 as an individual component. It can be seen that the sealing element 32 is frame-shaped. The sealing element 32 is closed all around. As a result, the sealing element 32 can also be arranged on the end faces of the channel cover element 17. The edge 29 of the channel cover element 17 is also provided on the end faces. This results in a particularly tight connection between the channel cover element 17 and the receiving area 16, in particular the shoulders 21, of the second channel section.

In order to brace the edge 29 of the channel cover element 17 against the shoulders 21 of the second channel section 15, two locking devices (not shown) are provided which engage in frontal recesses (not shown) in the channel cover element 17 and the first and/or second channel section 12, 15. The locking devices are designed in such a way that the edge 29 of the channel cover element 17 is pressed against the shoulders 21 and thus the lip 39 of the sealing element 32 positioned therebetween is compressed. The channel cover element 17 is fastened to the channel body 11 by the locking devices.

According to FIGS. 2 and 4, the channel cover element 17 has a channel 28 which is fluidically connected to the interior space 35 of the first channel section 12. Shower water to be drained during operation flows through the channel 28 into the interior space 35 of the first channel section 12. The channel 28 comprises an extension 42 with a passage 43 which projects into the first channel section 12. The passage 43 of the channel 42 is slot-shaped. In other words, the passage 43 is an elongated slot that runs in the longitudinal direction v. The passage 43 can extend over the entire length, in particular in the longitudinal direction v, of the channel cover element 17.

The channel cover element 17 is preferably accommodated substantially flush at the top in the second channel section 15. In other words, the channel cover element 17 is approximately flush with an upper edge of the side walls 34 of the receiving area 16. FIGS. 2 and 4 show that the channel cover element 17 is part of a siphon unit 200 for sealing the interior space 35 of the first channel section 12 against the second channel section 15 in an odor-shielding manner.

The shower channel 10 thus has a siphon unit 200. The siphon unit 200 comprises a siphon pot 33, wherein the channel cover element 17 protrudes into the siphon pot 33 to form a siphon. Specifically, the extension 42 of the channel 28 of the channel cover element 17 projects into the siphon pot 33 in such a way that a lower edge 44 of the extension 42 projects underneath an overflow edge 45 of the siphon pot 33. As a result, a constantly standing liquid level, in particular water level, is formed or can be formed in the siphon pot 33 after initial operation, even if the shower channel 10 is not in use.

FIGS. 1, 2, and 3 further show that the shower channel 10 has a sieve element 31 which is inserted into a recess 19 of the channel cover element 17. The recess 19 extends in the longitudinal direction v of the channel body 11. In the area of the longitudinal ends of the recess 19, one of the front recesses is arranged to accommodate the locking device. The front recesses are arranged below the sieve element 31 in the installed position. In addition to the channel 28, the sieve element 31 also covers the front recesses of the channel cover element 17.

The channel cover element 17 has a curve, in particular a rounded edge, in the transition from an upwardly oriented surface 46 to the recess 19. This ensures a comfortable feeling when stepping on the cover.

The sieve element 31 serves primarily as a hair sieve, but can also retain other contaminants from entering the underlying interior space 35 of the first channel section 12. The sieve element 31 can be a grate. The sieve element 31 has a plurality of through openings 47 through which shower water flows into the channel 28 underneath. The sieve element 31 can be designed in the shape of a U-profile. Alternatively, the sieve element 31 can be a flat material. Other shapes of the sieve element 31 are possible.

The through openings 47 are formed in FIG. 1 as oblique slots with respect to the longitudinal direction v. Alternatively or additionally, the through openings 47 can comprise or be round openings. Other shapes are possible.

FIGS. 2 and 4 further show that the shower channel 10 has two heat exchanger units 100 for heat recovery, which are arranged in the interior space 35 of the first channel section 12. During operation, the shower water to be drained flows directly around the heat exchanger units 100. In operation, the heat exchanger units 100 are therefore in direct contact with the shower water to be drained. As can be seen in FIGS. 2 and 4, the heat exchanger units 100 are connected in the flow direction downstream of the siphon unit 200.

The heat exchanger units 100 each have a heat transfer section 101 (shown as a black box) for a heat transfer medium. The heat transfer section 101 may comprise a plurality of tubes which are connected to one another, wherein the heat transfer medium can flow in the tubes. Alternatively or additionally, profile pipes, ducts, or the like are also conceivable.

The heat exchanger units 100 are each arranged between the siphon unit 200 and one of the side walls 14 of the first channel section 12. More specifically, the heat transfer section 101 of the respective heat exchanger unit 100 is arranged between one of the side walls 14 and the siphon pot 33. The heat exchanger sections 101 run in the longitudinal direction v of the channel body 11.

FIGS. 1 and 2 show that the heat exchanger units 100 each include a feed connection 102 and a return connection 103. The feed connection 102 and the return connection 103 are arranged on the side wall 14 of the first channel section 12 associated with the corresponding heat exchanger unit 100. The heat transfer medium enters the heat exchanger section 101 through the feed or return connection 102, 103 in order to absorb heat from the shower water flowing in the interior space 35 of the first channel section 12.

Figure 6:
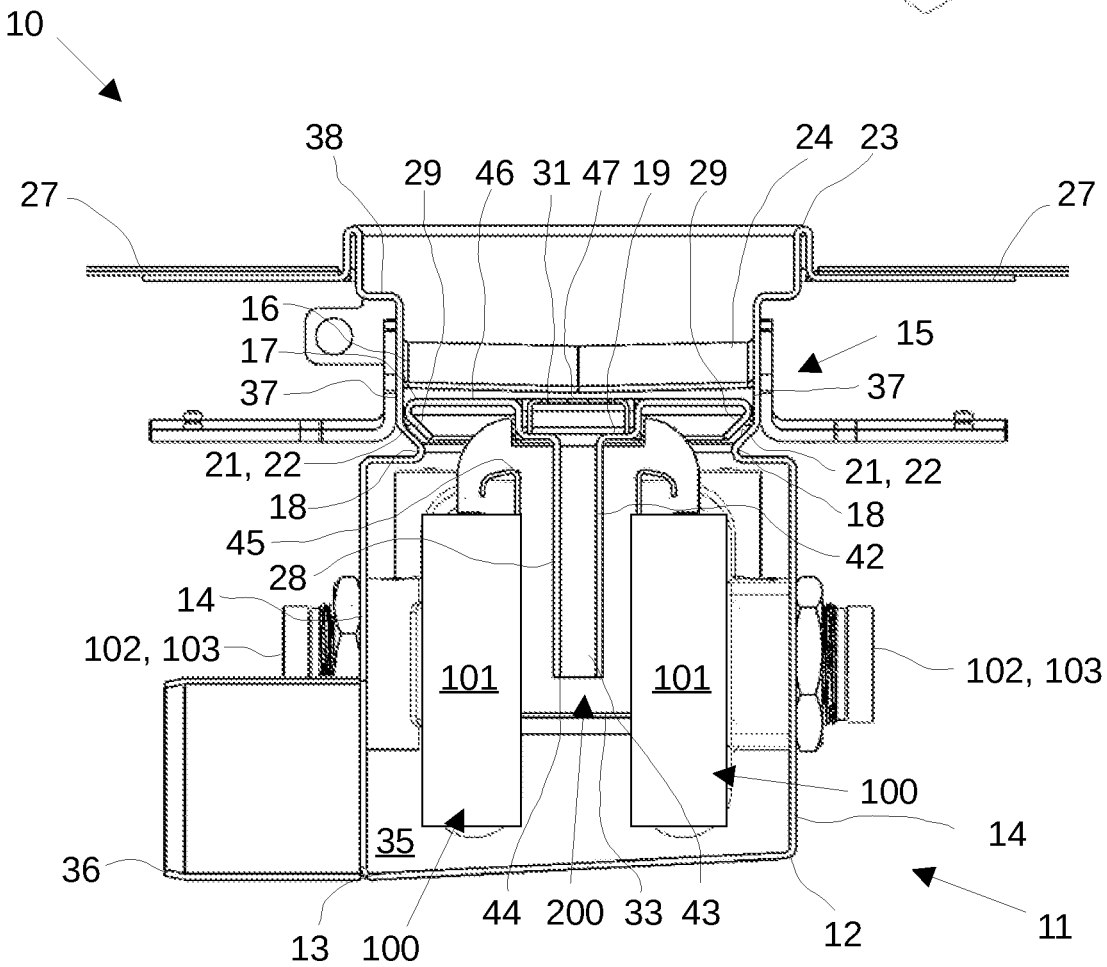
FIG. 6 shows a cross section of the drainage channel according to FIG. 5 in the area of the outlet nozzle.
Figure 7:
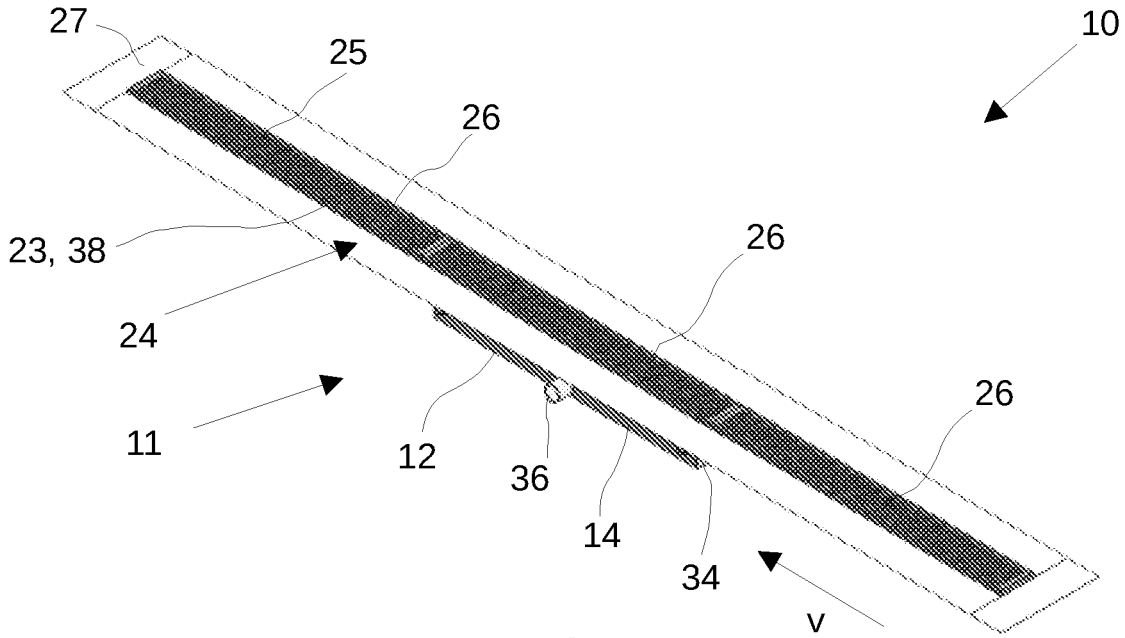
FIG. 7 shows a perspective view of the drainage channel according to FIG. 5 with other channel cover elements fully inserted.
Figure 8:
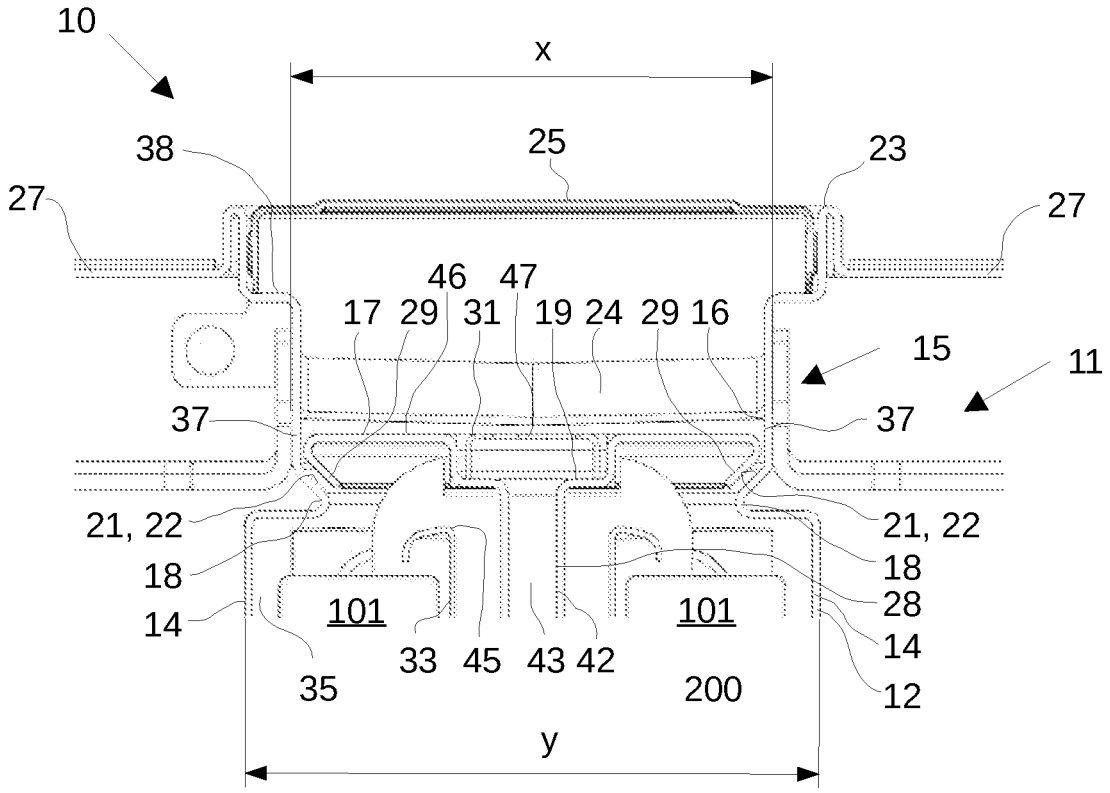
FIG. 8 shows a cross section of the drainage channel according to FIG. 5 and FIG. 7.

FIGS. 5 to 8 show a shower channel 10 according to a further exemplary embodiment according to the invention, which, in contrast to the shower channel 10 according to FIGS. 1 to 4, additionally has a third channel section 23 which adjoins the second channel section 15 above. The third channel section 23 is part of the channel body 11. The second channel section 15 is arranged between the first and third channel sections 12, 23. As can be clearly seen in the cross section of the shower channel 10 shown in FIGS. 6 and 8, the third channel section 23 forms an inlet 24 with a gradient for the shower water to be drained. The inlet 24 extends in the longitudinal direction v on both sides beyond the first and second channel sections 12, 15. In other words, the inlet 24 is elongated, comprising a slope towards the receiving area 16 of the second channel section 15 and thus towards the channel cover element 17. The third channel section 23 comprises another receiving area 38, in which several other channel cover elements 25 are arranged. Specifically, the other receiving area 38 accommodates a plurality of grate elements 26, which are arranged in a removable manner next to one another in the receiving area 38 (see FIGS. 7 and 8). FIGS. 5 and 6 show, for example, a state in which one of the grate elements 26 is removed from the other receiving area 38. It is possible that the shower channel 10 according to FIGS. 5 to 8 only accommodates a single grate element 26.

It is apparent from FIGS. 5 and 6 that the channel cover element 17 of the shower channel 10, unlike the shower channel 10 according to FIGS. 1 to 4, has two front-side recesses 41 for locking devices, which are arranged outside the recess 19. In other words, the frontal recesses 41 in the shower channel 10 according to FIG. 5 are not covered by the sieve element 31. Alternatively, the front recesses 41 for the locking device in the shower channel 10 according to FIGS. 5 to 8 can be arranged recessed in the recess 19, as in the shower channel 10 according to FIGS. 1 to 4.

Another difference between the shower channel 10 according to FIGS. 5 to 8 and the shower channel 10 according to FIGS. 1 to 4 is that the channel flange 27 is not arranged at the receiving area 16 of the second channel section 15 but at the other receiving area 38 of the third channel section 23. The channel flange 27 forms a collar surrounding the side walls 49 and end faces of the other receiving area 38. The collar protrudes laterally from the side walls 49 and the end faces and thus allows the attachment of a bottom surface, for example, a shower bottom.

At this point it should be noted that the features of the two exemplary embodiments of the shower channel 10 explained above can be freely combined with one another.

LIST OF REFERENCE NUMERALS

10 drainage channel, shower channel
11 channel body
12 first channel section
13 bottom
14 side wall of the first channel section
15 second channel section
16 receiving area
17 channel cover element
18 undercut
19 recess
21 shoulder
22 support surface
23 third channel section
24 inlet
25 other channel cover element
26 grate
27 channel flange
28 duct
29 edge
31 sieve element
32 sealing element
33 siphon pot
34 end wall
35 interior space of the first channel section
36 outlet nozzle
37 side walls of the second channel section
38 other receiving area
39 lip of the sealing element
41 frontal recesses
42 extension of the channel
43 passage of the channel
44 lower edge of the protrusion
45 overflow edge
46 surface
47 through openings
100 heat exchanger unit
101 heat transfer section
102 feed connection
103 return connection
200 siphon unit
v longitudinal direction
x outer width of the second channel section
y width of the first channel section

What is claimed is:

1. A drainage channel (10) for sanitary facilities, with a channel body (11) extending in a longitudinal direction (v), comprising:

at least one first channel portion (12) having a bottom (13) and at least two side walls (14) arranged opposite one another on the bottom (13), wherein the first channel portion (12) is adapted to accommodate at least one heat exchanger unit (100) for heat recovery; and at least one second channel portion (15) with a receiving region (16) for receiving a channel cover element (17), which adjoins the first channel portion (12) from above, at least one third channel portion (23) which adjoins the second channel portion (15 from above, the second channel portion (15) is arranged between the first and third channel portions (12, 23), wherein the channel body (11) has at least one undercut (18) through which the receiving region (16) of the second channel portion (15) is arranged transversely to the longitudinal direction (v) within at least one of the side walls (14) of the first channel portion (12).

2. The drainage channel (10) according to claim 1, the undercut (18) is an indentation of the channel body (11) that extends towards the center of the channel and is formed between the first and second channel portions (12, 15).

3. The drainage channel (10) according to claim 1, the receiving region (16) of the second channel portion (15) comprises at least one shoulder (21) extending towards the center of the channel for supporting the channel cover element (17).

4. The drainage channel (10) according to claim 3, the shoulder (21) is formed by the undercut (18) and has at least one support surface (22) which is oriented obliquely towards the center of the channel.

5. The drainage channel (10) according to claim 1, the third channel portion (23) forms at least one inlet (24) for the liquid to be drained, which inlet extends in the longitudinal direction (v) at least beyond the first and/or second channel portion (12, 15).

6. The drainage channel (10) according to claim 1, the third channel portion (23) comprises at least one further receiving region (38) for at least one further channel cover element (25).

7. The drainage channel (10) according to claim 6, at least one channel flange (27) for connecting a surface to be drained is arranged peripherally extending on the outside of the receiving region (16) of the second channel portion (15) and/or of the further receiving region of the third channel portion (23), wherein the undercut (18) of the channel body is formed at least in portions between the channel flange (27) and the first channel portion (12).

8. The drainage channel (10) according to claim 1, at least one channel cover element (17) which is accommodated in the receiving region (16) of the second channel portion (15) and has a channel (28) which is fluidically connected to the first channel portion (12).

9. The drainage channel (10) according to claim 8, the channel cover element (17) has at least one edge (29) which runs obliquely towards the center of the channel and which rests on a shoulder (21) in the receiving region (16) of the second channel portion (15).

10. The drainage channel (10) according to claim 9, the oblique edge (29) is designed to complement the shoulder (21) of the second channel portion (15).

11. The drainage channel (10) according to claim 10, the channel cover element (17) has at least one recess (19) above the channel (28), in which at least one sieve element (31) is inserted.

12. The drainage channel (10) according to claim 9, at least one sealing element (32) is arranged between the edge (29) of the second channel portion (15) and the shoulder (21) of the second channel portion (15).

13. The drainage channel (10) according to claim 9, the channel cover element (17) can be or is braced by at least one locking device against the shoulder (21) of the second channel portion (15) for compressing the/a sealing element (32).

14. The drainage channel (10) according to claim 13, at least one siphon unit (200) with a siphon pot (33), wherein the channel cover element (17) protrudes into the siphon pot (33) to form a siphon.

15. The drainage channel (10) according to claim 1, at least one heat exchanger unit (100) which is arranged in the channel body (11) in such a way that, during operation, a liquid to be drained flows at least in portions around the heat exchanger unit (100).

16. The drainage channel (10) according to claim 15, the heat exchanger unit (100) has at least one heat transfer portion (101) which portion runs at least in portions in the longitudinal direction (v) along at least one of the side walls (14) of the channel body (11).

17. The drainage channel (10) according to claim 16, the heat exchanger unit (100) comprises at least one feed connection (102) and at least one return connection (103), wherein the feed connection (102) and/or the return connection (103) is/are arranged on an end wall (34) of the channel body (11) or on one of the side walls (14) of the channel body (11).

18. The drainage channel (10) according to claim 1, the channel body (11) has at least one outlet nozzle (36) for the liquid to be drained, which outlet nozzle is arranged on an end wall (34) of the channel body (11) or on one of the side walls (14) of the channel body (11) or on the bottom (13) of the channel body (11).

19. A use of a drainage channel (10) according to claim 1, in a sanitary facility, wherein the drainage channel (10) is inserted into a shower bottom in such a way that liquids to be drained away during use of the sanitary facility run off through the drainage channel (10), wherein heat recovery takes place through at least one heat exchanger unit (100).

20. The drainage channel (10) according to claim 1, wherein the receiving region (16) of the second channel portion (15) is arranged transversely to the longitudinal direction (v) within at least two of the side walls (14) of the first channel portion (12).

21. A drainage channel (10) for sanitary facilities, with a channel body (11) extending in a longitudinal direction (v), comprising:

at least one first channel portion (12) having a bottom (13) and at least two side walls (14) arranged opposite one another on the bottom (13), wherein the first channel portion (12) is adapted to accommodate at least one heat exchanger unit (100) for heat recovery; and at least one second channel portion (15) with a receiving region (16) for receiving a channel cover element (17), which adjoins the first channel portion (12) from above, the receiving region (16) of the second channel portion (15) has an outer width (x) transversely to the longitudinal direction (v), which is smaller than a width (y) of the first channel portion (12), wherein the channel body (11) has at least one undercut (18) through which the receiving region (16) of the second channel portion (15) is arranged transversely to the longitudinal direction (v) within at least one of the side walls (14) of the first channel portion (12).

* * * * *